US006893282B2

(12) United States Patent
Schadhauser

(10) Patent No.: US 6,893,282 B2
(45) Date of Patent: May 17, 2005

(54) BAYONET BASE FOR LAMP MOUNT

(75) Inventor: Klaus Schadhauser, Munich (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/460,301

(22) Filed: Jun. 13, 2003

(65) Prior Publication Data

US 2004/0023540 A1 Feb. 5, 2004

(30) Foreign Application Priority Data

Jun. 14, 2002 (DE) ..... 102 26 761

(51) Int. Cl.[7] ..... H01R 13/625

(52) U.S. Cl. ..... 439/332; 439/670; 439/671; 439/672

(58) Field of Search ..... 439/670, 671, 439/672, 673, 332, 336, 687, 696, 906

(56) References Cited

U.S. PATENT DOCUMENTS

| | | | | | |
|---|---|---|---|---|---|
| 2,340,822 | A | * | 2/1944 | Scott | 439/332 |
| 3,864,172 | A | * | 2/1975 | Marks | 439/332 |
| 4,003,618 | A | * | 1/1977 | Booty | 439/332 |
| 6,126,473 | A | * | 10/2000 | Whorton | 439/332 |
| 6,599,145 | B2 | * | 7/2003 | Singh | 439/332 |
| 6,607,293 | B2 | * | 8/2003 | Sanuki et al. | 439/336 |

* cited by examiner

*Primary Examiner*—Tho D. Ta

(57) ABSTRACT

Lamp mounts for tubular fluorescent lamps with a screw base are to be configured in a more compact manner for packaging purposes. A bayonet adapter (5) which can be rotated into a lamp mount (1) is provided for this purpose. The bayonet adapter (5) has, for example, an E27-type screw base opposite the bayonet connector (9). Since the bayonet adapter (5) can be removed from the lamp mount (1), a corresponding luminaire can be packaged in a more compact manner.

1 Claim, 3 Drawing Sheets

BAYONET BASE FOR LAMP MOUNT

TECHNICAL FIELD

The present invention relates to a bayonet adapter and, in particular, to a bayonet base for illumination means. The present invention also relates to a lamp mount having a retaining device for bearing an illumination means and for the electrical contact-connection of the illumination means.

BACKGROUND ART

In addition to conventional incandescent lamps with an E27-type lamp base, for example toroidal or elongate tubular fluorescent lamps with an E27 base are also available. An electrical ballast (EVG) is also integrated here in the lamp mount of the tubular fluorescent lamps. Since the E27 base is arranged perpendicularly to the direction or plane in which the respective tubular fluorescent lamp extends, comparatively bulky packaging has to be provided for the tubular fluorescent lamps.

DISCLOSURE OF THE INVENTION

The object of the present invention is thus to design lamps with a reduced packaging volume.

This object is achieved according to the invention by a bayonet adapter for illumination means, having a first contact device for the contact-connection of a power source, and a second contact device, which is connected electrically to the first contact device and which is configured as a bayonet connector or bayonet bushing, via which it is possible to produce electrical contact with a corresponding bayonet counterpart.

Also provided for the purpose of achieving the above-mentioned object is a lamp mount having a retaining device for bearing an illumination means and for the electrical contact-connection of the illumination means, and a power-connection device configured as a bayonet connector or bayonet bushing, which is in electrical connection with the retaining device and via which it is possible to produce an electrical contact with a bayonet counterpart.

In the case of an advantageous configuration of the bayonet adapter, the first contact device comprises a lamp base, in particular an E27 base. It is thus possible for the bayonet adapter to be screwed into a commercially available E27 holder and for a lamp mount according to the invention to be rotated onto the bayonet adapter. The first contact device may likewise be configured as a mounting box with clamping device in particular for mounting on a wall.

The second contact device advantageously comprises a bayonet connector with a cylindrical main portion. As bayonet claw, the main portion has at least one nose which projects out of the main portion essentially perpendicularly to the cylinder axis. The bayonet connector preferably comprises two such noses.

The noses of the bayonet closure may also be used, at the same time, for producing electrical contact between the bayonet connector and the bayonet bushing. For this purpose, it is advantageous if the nose and the cylindrical main portion consist essentially of insulating material, commonly of plastic. It is expedient here if the adapter body comprises two injection-molded halves, which are plugged together for mounting purposes. This allows contact wires to be positioned in one of the injection-molded halves, to be precise both in the main portion of the latter and in the noses thereof.

In order to avoid the risk of electric shock which exists when the bayonet adapter is rotated into a lampholder, the contact locations should be concealed in the noses such that they usually cannot be touched. A first measure makes this possible in that the contact wires in the noses are only accessible from the outside in small slots on the rear side of the nose, as seen in the plug-in direction of the bayonet connector. This, for the most part, does away with the risk of open contact locations being touched.

In order for the risk of electric shock to be curbed further, the slots for the contacts may be provided with integrally molded coverings which, upon rotation into the bayonet bushing, break off and thus expose the contact slots. It is advantageous here if each slot covering has a lamellar extension or a lug in the direction of the cylinder axis of the main portion, by way of which the slot covering can be readily broken off during rotation of the bayonet components.

The bayonet bushing essentially comprises a base plate with a bore which is adjoined by at least one groove, usually two grooves. For the contact-connection with contact locations of the noses of the bayonet connector, contact bridges are arranged tangentially outside the bore and within the circle which is determined by the radius from the center of the bore to the distal end of a groove. This arrangement makes it possible for the contact locations to be rotated onto the contact bridges by the rotation of the bayonet closure, the electrical connection being produced as a result.

The lamp mount preferably has an electronic ballast for a tubular fluorescent lamp.

If clamping devices, e.g. screw-type terminals or plug-in terminals, are provided parallel to the electrical bayonet-bushing connections, it is left up to the owner of the lamp mount to use the adapter to rotate the same into a lampholder or to mount the lamp mount in a luminaire or on a wall.

For reasons of avoiding the risk of electric shock, the bayonet adapter should be rotated into the bayonet counterpart of the lamp mount such that it cannot be removed. This can be realized by latching hooks which are fitted on the bayonet connector or the bayonet bushing. This makes it possible to prevent removal once mounting has taken place, which in particular has the advantage that the slot coverings broken off for contact-connection purposes are no longer openingly accessible.

BRIEF DESCRIPTION OF THE DRAWINGS

The invention will be explained in more detail hereinbelow with reference to a number of exemplary embodiments, in which.

BEST MODE FOR CARRYING OUT THE INVENTION

Figure 1:
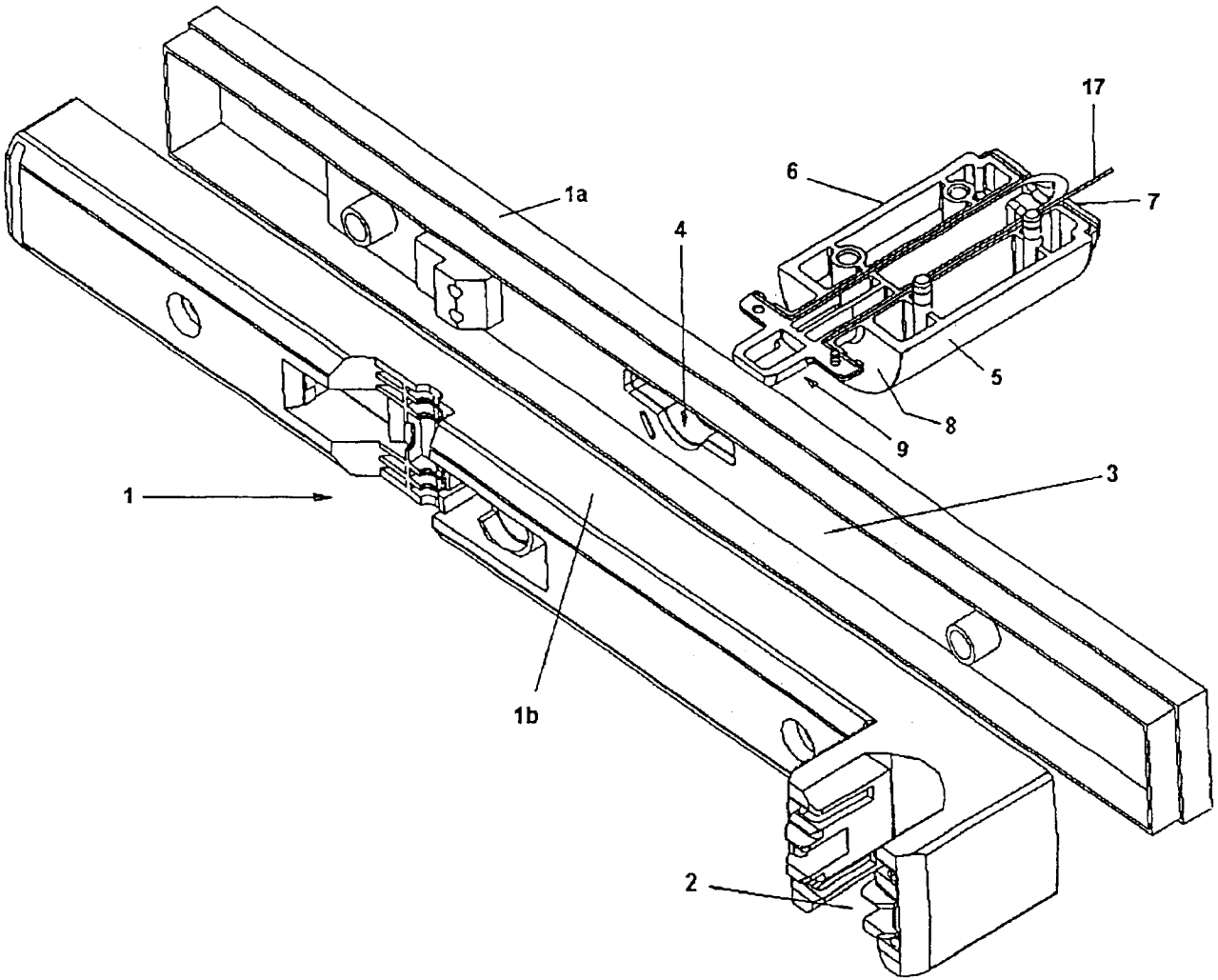
FIG. 1 shows a perspective view of an injection-molded half of a bayonet adapter according to the invention and of a lamp mount according to the invention with two enclosure halves, in an exploded illustration.

FIG. 1 represents a lamp mount 1 with two enclosure halves 1*a* and 1*b* in an exploded illustration. The top enclosure half 1*b* has a holder 2 into which a toroidal tubular fluorescent lamp (not illustrated) can be plugged in from above. The tubular fluorescent lamp has a torus diameter which corresponds to the longitudinal dimension of the lamp mount 1. In the bottom enclosure half 1*a* of the lamp mount 1, an electrical ballast (not illustrated) is accommodated on a printed circuit board 3. Furthermore, a bayonet bushing 4 is provided in the housing of the lamp mount 1. A bayonet connector 9 of a bayonet adapter 5 can be plugged into this bayonet bushing 4 and latched in by rotation. FIG. 1 merely illustrates half of the bayonet connector 9 of the bayonet adapter 5, it being possible for the bayonet connector to be joined together from injection-molded halves. The bayonet adapter 5 has an essentially cylindrical body 6. It is possible for a lamp base (not illustrated), e.g. an E27 lamp base, to be fitted, as first contact device, on one end side 7 of said cylindrical body and to be connected to contact wires 17 which are positioned in the bayonet adapter 5. The bayonet-connector mechanism 9 is located on the opposite end side 8.

Figure 2:
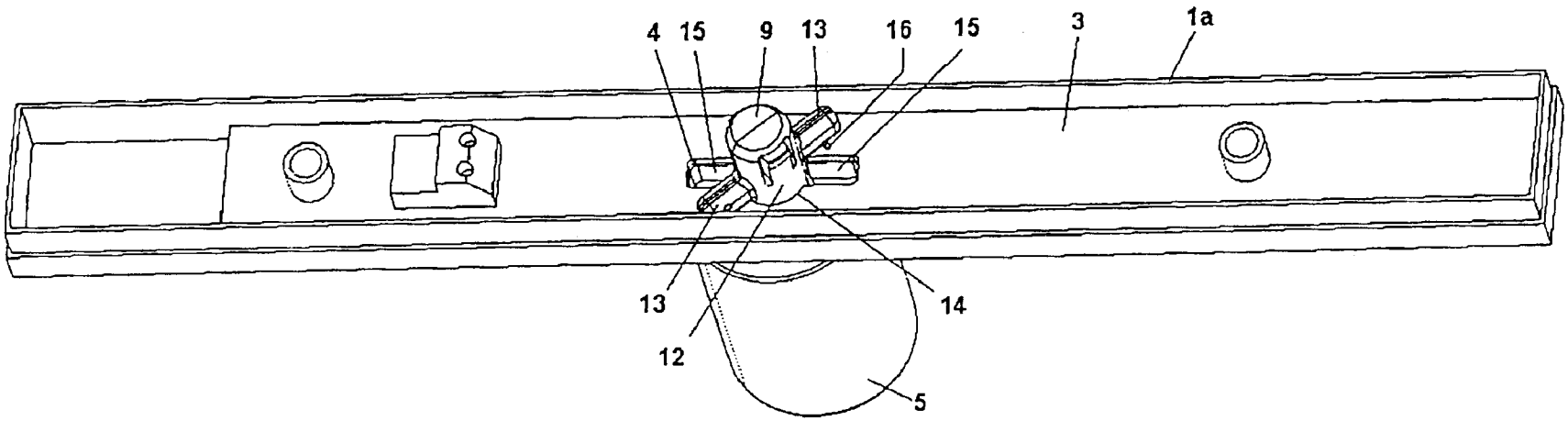
FIG. 2 shows a perspective view of a bayonet adapter rotated into the bottom enclosure half of a lamp mount.

FIG. 2 illustrates the full bayonet adapter 5, albeit likewise without the lamp base, rotated into the bottom enclosure half 1*a* of the lamp mount 1. For reasons of clarity, FIG. 2 merely illustrates the bottom housing half 1*a* of the lamp mount 1. This housing half 1*a* bears a printed circuit board 3.

The bayonet connector 9 of the bayonet adapter projects through the opening of the bayonet bushing 4. The bayonet connector 9 comprises a cylindrical main portion 12 and mutually opposite noses 13 projecting laterally, essentially perpendicularly to the cylinder axis.

Accordingly, the bayonet bushing 4 has a bore 14 and adjoining, mutually opposite grooves 15. The grooves 15 and the bore 14 are slightly larger than the noses 13 and the cylindrical main portion 12 of the bayonet connector 9.

The printed circuit board 3 bears two contact bridges 16, over which the noses 13 of the bayonet connector 9 are rotated.

Figure 3:
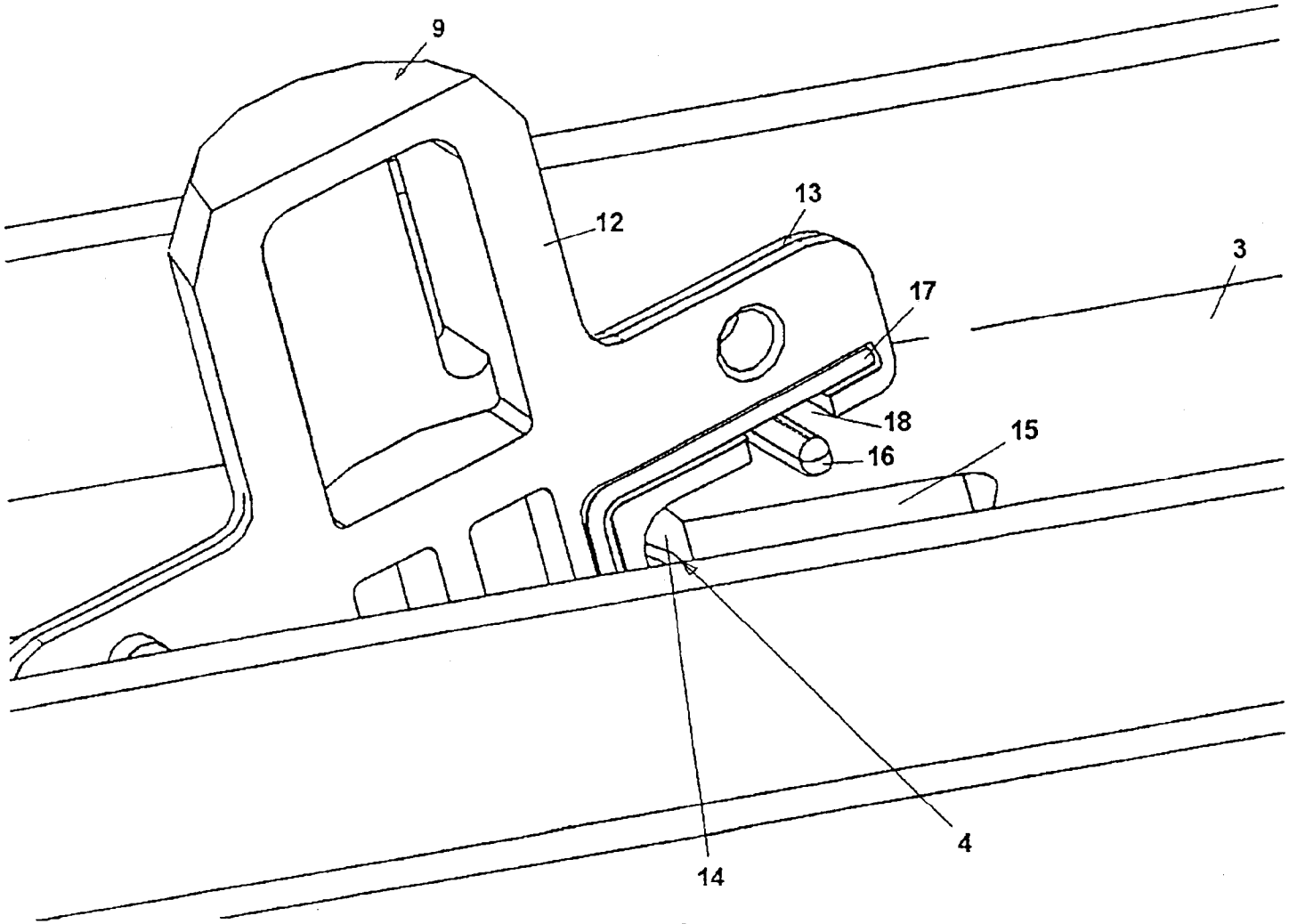
FIG. 3 shows a perspective view of one bayonet-adapter half rotated into the bottom enclosure half of a lamp mount.

One half of the bayonet closure is illustrated on an enlarged scale in FIG. 3. The contact wires 17 have been positioned in this half of the bayonet adapter 5. They run, as is illustrated in FIG. 1, in the cylinder casing of the bayonet connector 9 and project into the noses 13. On the underside of each nose 13, that is to say on that side which in the plugged-in state is directed toward the printed circuit board 3, each nose 13 has an opening or a slot 18. Through this opening, the contact wire 17 can be forced onto the contact bridge 16 when the bayonet connector 9 is rotated into the bushing 4.

As has already been mentioned, a covering (not illustrated) may be integrally molded on the nose 13 in the region of the opening 18. The covering, furthermore, may have a lug which extends downward, i.e. in the direction of the cylinder axis of the main portion 12 of the connector 9, beneath the opening. When the bayonet connector 9 is rotated in, this lug, including the covering of the nose 13, is broken off, with the result that it is possible to produce the contact between the wire bridge 16 and the contact wire 17.

Furthermore, in the region of the bushing 4, the lamp mount 1 has latching hooks (not illustrated) which engage in latching teeth (not illustrated either) of the bayonet connector 9, with the result that it is no longer possible for the latter, once rotated in, to be rotated back. This makes it possible to prevent the situation where the now absent coverings over the openings 18, the coverings having been broken off when the bayonet connector is rotated in, allow the contact wires 17 to be touched following removal of the lamp mount 1 from the bayonet adapter 5.

It is also possible for the bayonet adapter 5, on the side 7 located opposite the bayonet connector 9, to be configured, for example, as a wall-mounting box with a corresponding clamping device or the like. It would thus be possible for the wall-mounting box to be mounted on a power outlet on the wall and for the lamp mount 1, possibly with the electronic ballast fitted on the printed circuit board 3, to be rotated onto the wall-mounted bayonet connector 9.

What is claimed is:

1. A lamp mount, comprising:

a power-connection device comprising a bayonet bushing adapted to receive a bayonet connector;

a retaining device for bearing an illumination means and for electrical connection with the illumination means, wherein the retaining device is electrically coupled to the power-connection device; and an electrical ballast on a printed circuit board, wherein the electrical ballast and the printed circuit board are electrically coupled to the power-connection device.

* * * * *